United States Patent [19]

Chatenay épouse Compagnone

[11] Patent Number: 4,662,628

[45] Date of Patent: May 5, 1987

[54] DEVICE FOR MANEUVERING SCENERY

[76] Inventor: Catherine M. Chatenay épouse Compagnone, 70 rue Mouffetard, 75005 Paris, France

[21] Appl. No.: 786,510

[22] Filed: Oct. 11, 1985

[30] Foreign Application Priority Data

Oct. 17, 1984 [FR] France ..... 84 15919

[51] Int. Cl.[4] ..... A63J 1/02

[52] U.S. Cl. ..... 272/22; 254/278

[58] Field of Search ..... 272/21, 22, 23, 24; 187/20, 27; 254/329, 288, 278; 212/200, 209, 210, 213

[56] References Cited

U.S. PATENT DOCUMENTS

| | | | |
|---|---|---|---|
| 3,558,102 | 1/1971 | Cruse | 272/22 X |
| 3,650,215 | 3/1972 | Werthessen | 212/209 X |
| 3,702,124 | 11/1972 | Highland | 272/24 X |
| 4,199,133 | 4/1980 | Gagnon et al. | 272/22 X |
| 4,324,386 | 4/1982 | Gagnon et al. | 272/22 X |

FOREIGN PATENT DOCUMENTS

| | | | |
|---|---|---|---|
| 938656 | 2/1956 | Fed. Rep. of Germany | 272/22 |
| 1152524 | 8/1963 | Fed. Rep. of Germany | 272/22 |
| 3233468 | 3/1984 | Fed. Rep. of Germany | 272/22 |
| 607583 | 5/1978 | U.S.S.R. | 272/22 |

*Primary Examiner*—Robert A. Hafer
*Assistant Examiner*—Arnold W. Kramer
*Attorney, Agent, or Firm*—Fisher, Christen & Sabol

[57] ABSTRACT

This invention relates to a device for maneuvering scenery, particularly for stages of theaters and the like. The device includes at least two main rails mounted above the stage, running parallel with respect to each other and symmetrically with respect to the axis of the stage. On each of the rails is a radio transmitter-controlled motorized carriage. A batten having scenic background cloth supported therefrom is suspended from each of its ends by belts extending from each of the carriages. A remote controlled powered winch is provided for each of the suspension belts so that the batten can be raised or lowered through remote control of the winch. The device is particularly applicable to pre-fabricated standardized theater scenery.

4 Claims, 6 Drawing Figures

33
23
24
25
27
15
2
28
8
22
18
19
16
17
20

Fig. 3
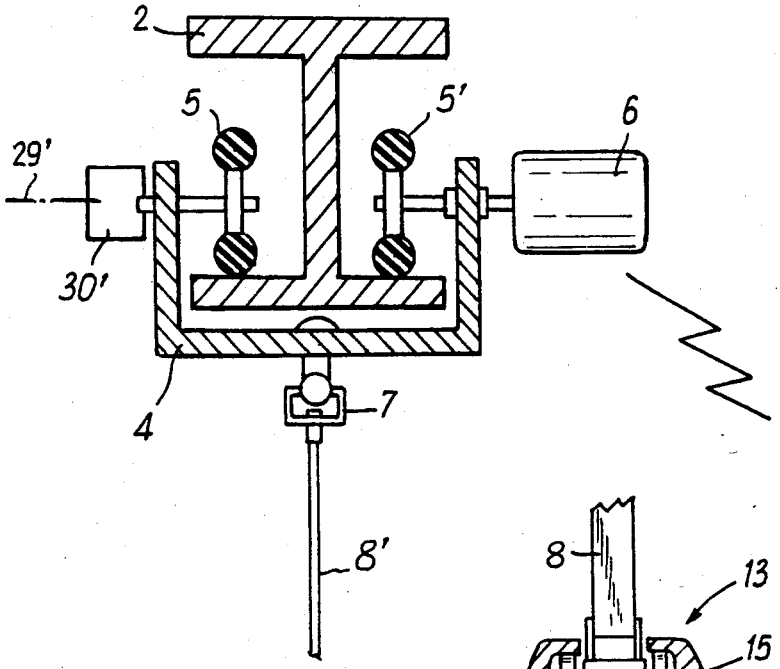
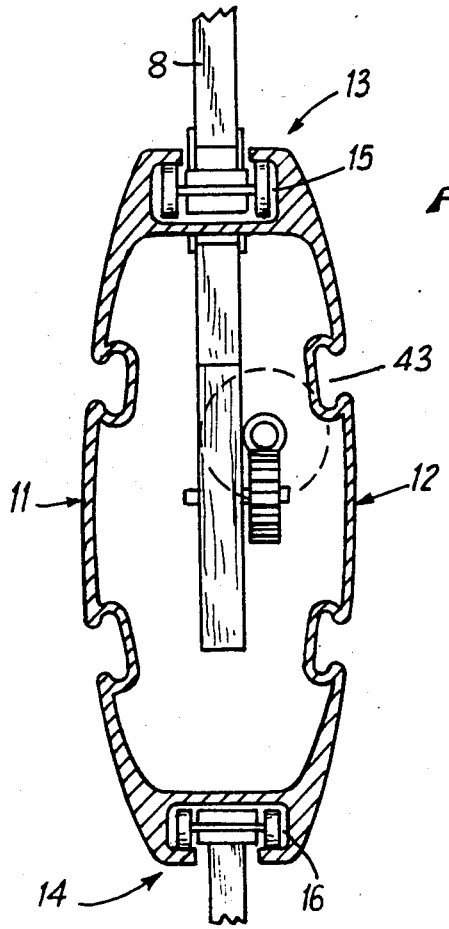
Fig. 4

DEVICE FOR MANEUVERING SCENERY

The present invention relates to a device for manoeuvring scenery, which may be prefabricated in the workshop and rapidly set up on the stage of a theatre, entertainment hall or the like.

Devices known at present for manoeuvring scenery and adapted to be displaced in and on the stage go back to the beginnings of the theatre.

In the conventional systems, the scenery made on a supple support such as a cloth is suspended from a bar or batten disposed perpendicularly with respect to the median axis of the auditorium and of the stage and capable of being raised and lowered by a set of pulleys.

However, such systems require specialized manpower both for maintenance and manoeuvre thereof.

In addition, the conventional systems allow only relatively limited scenic effects; the battens supporting the scenery are displaced in one direction only, the support battens always being parallel to themselves and always located in the same vertical plane.

The present invention intends to improve to a considerable extent the devices for arranging scenery.

It is a first object of the invention to provide the standardized arrangement of scenery in theatres or the like from basic systems which may be manufactured in the factory or workshop and set up in situ.

The work involved in specific study for adaptation to each particular case is thus avoided, as well as the work involved in setting up scenery as a function of the local environment.

Mass-production is thus possible by using a standard system adaptable to multiple configurations, as well as a considerable reduction in the cost price.

It is another object of the invention to multiply the manoeuvres with respect to the manipulations and displacements of scenery limited within the framework of the prior known devices.

It is a further object of the invention to combine such multiplication of possibilities of scenery with a considerable simplification of the means employed, particularly by eliminating the complex, interlaced networks of flies passing over the ceiling and sides of the stage.

Yet another object of the invention is to provide a device whose manoeuvre may be entirely automated and programmed, centralized from a control device associated with data-processing means, thus completely eliminating the necessary maintenance by specialized staff.

In fact, the invention enables the manoeuvring of the scenery to be completely mechanized and enables it to be remotely controlled possibly employing programming means, capable of being associated with the control of elements such as lighting or sound effects, with the result that the use of the scenic means according to the invention will allow, with the reduction in the cost price in the equipment of theatres and the like, new possibilities of theatrical development and a renewal in the concepts and creations of dramatic art.

To this end, the invention relates to a device for manoeuvring scenery, particularly for stages of theatres and the like, characterized in that it comprises at least two paired rails, the two rails running parallel to each other and symmetrically with respect to the axis of the stage, and being disposed at the top of said stage. Each rail has a carriage movable along said rail. The carriages move together in pairs on each respective rail. Each carriage has a supple tie for supporting one end of a batten disposed in a direction substantially perpendicular to the rails. The batten is adapted to receive scenery suspended therefrom in known manner, and the batten is movable in height by manoeuvring said supple ties by means of at least one motorized winding device disposed fast on said batten.

The invention will be more readily understood on reading the following description with reference to the accompanying drawings, in which:

FIG. 3 shows a detailed view of the rail bearing the carriage for the suspension of the scenery-supporting beam.

FIG. 4 shows a view in transverse section of the beam supporting scenery.

Figure 1:
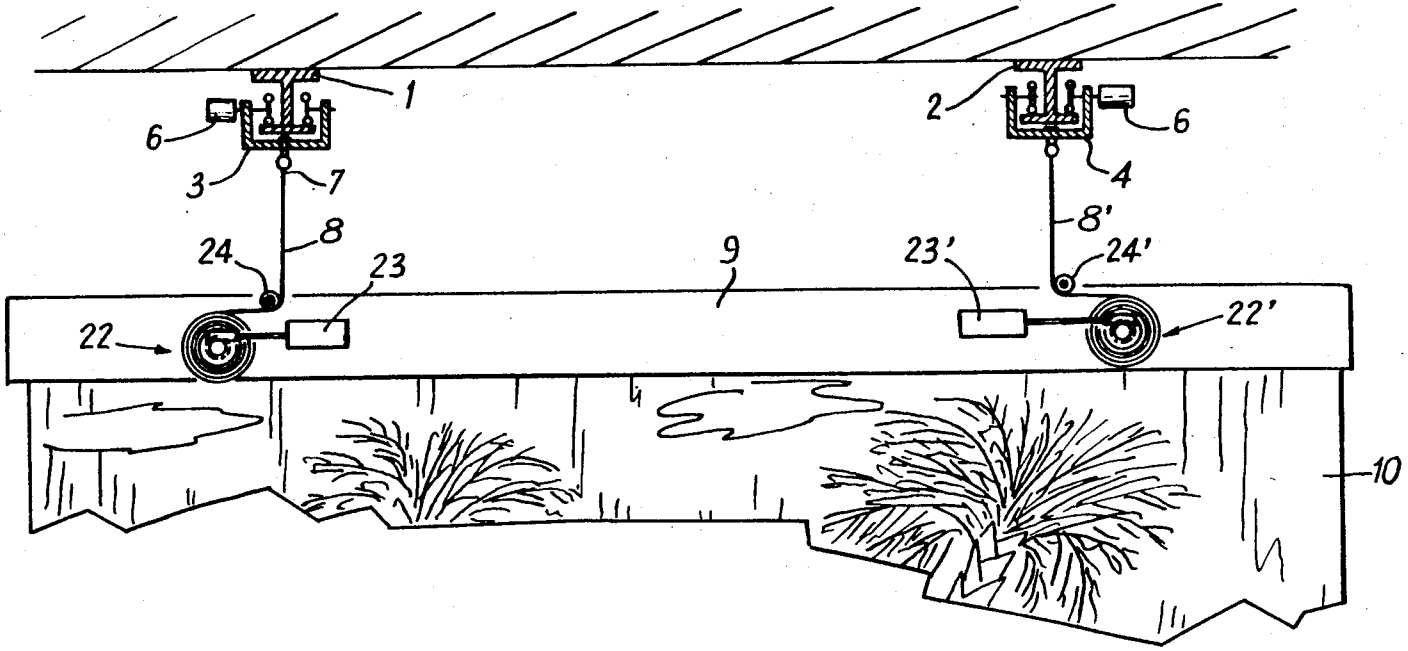
FIG. 1 shows a front elevation view, with partial transverse section at the level of the rails and longitudinal section at the level of the beam, of the scenic device according to the invention.

Referring now to the drawings, the device according to the invention comprises two paired rails 1 and 2 disposed parallel to each other and symmetrically with respect to the median axis of the stage.

The rails run at the top of the stage area; however, they may advantageously cover the whole area of the theatre and advance over the ceiling of the theatre itself.

These rails are constituted for example by I-sectioned girders fastened in any known manner to the ceiling of the stage and possibly of the audito- rium.

Each of the two paired rails bears a plurality of carriages 3 and 4 movable along the rail via rollers 5, 5'.

One of the rollers is associated with motorization means, for example an electric motor 6.

Each of the rails 1 and 2 is made of an electrically conducting material, for example metal such as steel, and each of the rails is connected to one of the poles of an electrical supply circuit, for example a low-voltage 24-volt D.C. electrical circuit.

As will be seen hereinafter, the 24-volt supply avoids the risks of short-circuit or of danger for the staff.

The carriages 3 and 4 comprise at their bases a swivel joint or Universal joint 7 supporting the top of a suspension belt 8, 8', itself supporting at its base the batten 9 from which the scenery 10 is suspended.

The batten 9 is advantageously constituted by an extruded aluminium section of which the profile is shown in FIG. 4. In section, it presents two outwardly convex lateral faces 11 and 12, the faces at the top 13 and base 14, respectively; comprising grooves 15 and 16 whose edges approach each other.

These grooves accommodate mini-carriages mounted on rollers both in the upper part and in the lower part.

Figure 2:
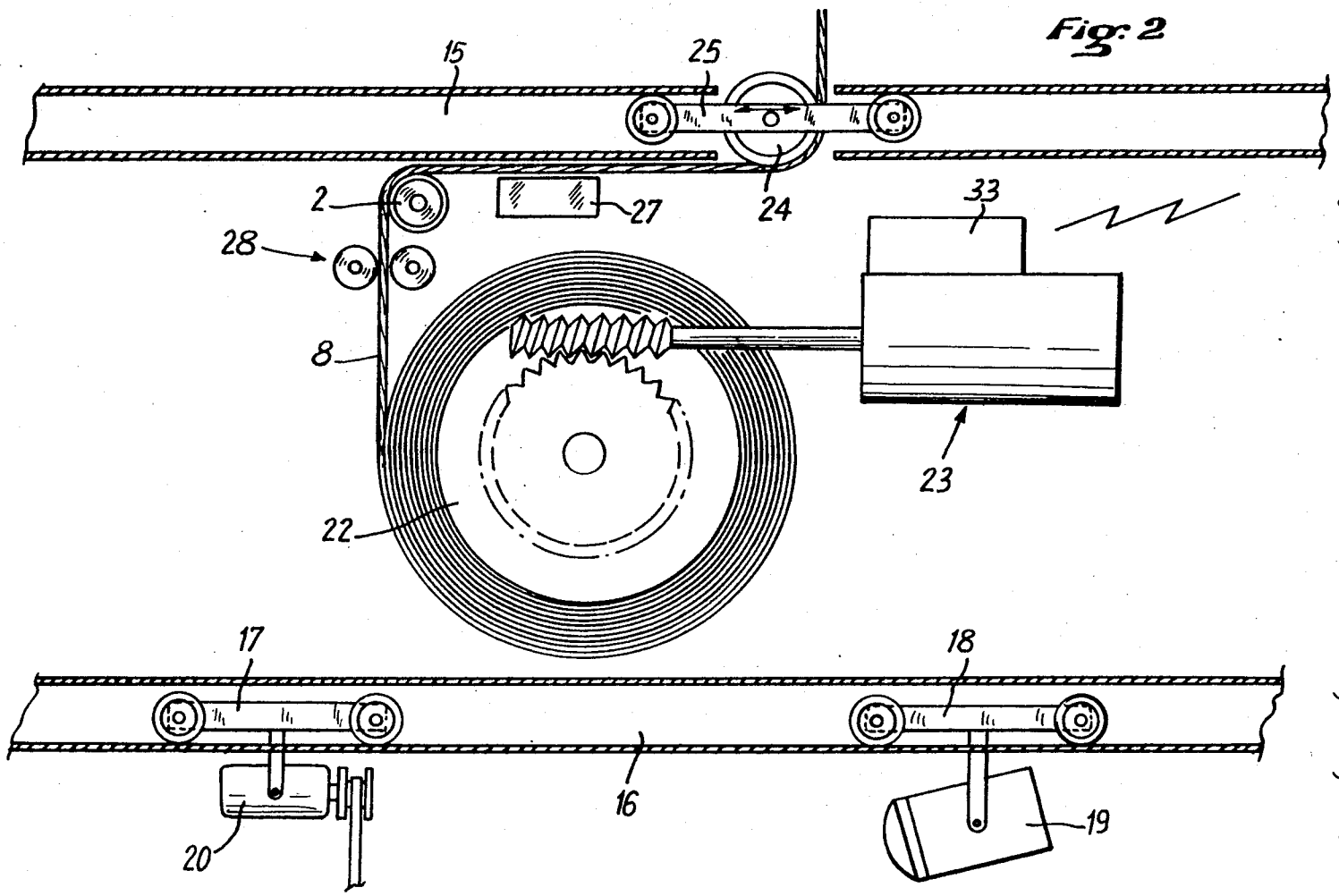
FIG. 2 shows a detailed view of the device for manoeuvring the suspension belt inside the scenery-supporting beam.

In the lower part, and as is shown in FIG. 2, these mini-carriages 17, 18 make it possible to suspend in lower position accessories such as spot lights 19 or suspension and manoeuvring winches 20 allowing the vertical displacement of accessories or of independent stage props; the mini-carriages may advantageously be motorized and supplied as will be seen hereinafter.

The low-voltage electric current circulating in rails 1 and 2 may pass in carriages 3 and 4 provided to ensure an electrical contact, for example by a simple mobile contact sweeping over the surface of the rail as the carriage is displaced, in manner known per se. The current may then be connected to belts 8, 8' which, to this end, are provided either to be made of conducting material (metallic braid) or to be associated with a conducting wire.

Consequently, the current may be conducted by belts 8 and 8' to batten 9; insulating means are provided so that the current supplying the batten 9 from belts 8 and 8' is insulated with respect to the metallic mass of the batten 9.

The two low-voltage D.C. poles may then be connected to the various electrical apparatus used in or on the batten 9, for example, as has just been seen, the motorization of the mini-carriages 17, 18.

This current is used in particular for manoeuvring the suspension belts 8 and 8'.

The terminal part of these belts, at batten level, is wound on the drum of a manoeuvring winch 22 manoeuvred from the motorization device 23.

The latter will advantageously be constituted by a hydraulic winch supplied by an electric motor pump.

The suspension belts 8 and 8' are constituted by flattened bands enabling them to be wound on the drum 22 in successive, superposed turns, as shown in FIG. 2; this allows a winding in thickness, the maximum winding corresponding to the raising of the batten in the vicinity of the support carriage.

The batten comprises, plumb with each support carriage, a guide pulley 24, 24' itself mounted on the mini-carriage 25 (FIG. 2) capable of moving inside the upper groove 15 of the beam (FIG. 4), thus allowing, at least in a limited zone, the longitudinal displacement of the pulley 24. The mini-carriage is motorized and its bearing may abut on a rack rail.

Figure 5:
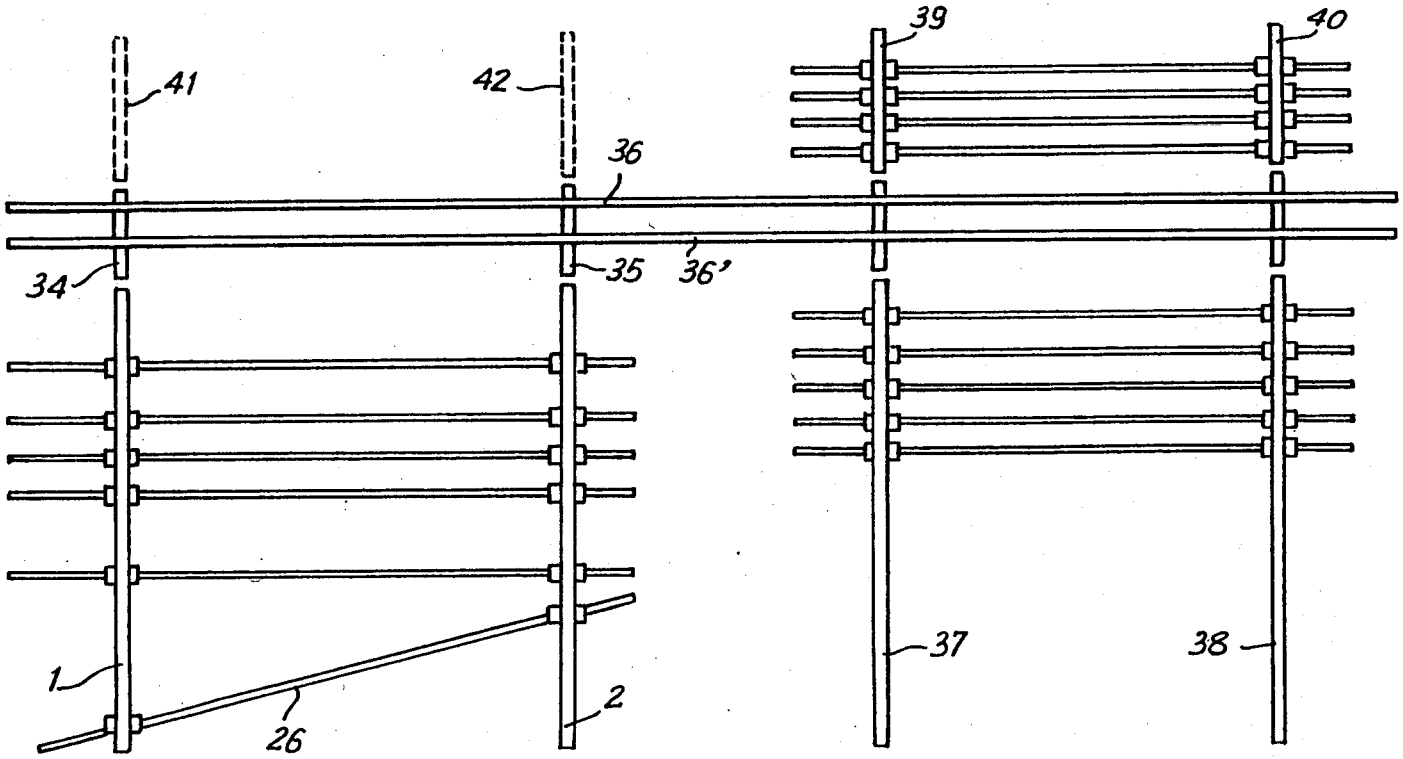
FIG. 5 shows a plan view of the scenic device according to the invention.

Displacement of pulley 24 will allow the oblique positioning of the batten, as in the case of batten 26 seen in FIG. 5, whilst allowing each guide pulley 24, 24' to remain plumb with the upper carriage.

The assembly for manoeuvring the belt 8 (FIG. 2) also comprises a reading device 27.

To that end, belt 8, 8' is provided with marks spaced out over its length, for example coded magnetic marks or optical marks, the reading device being provided to locate said coded signals in order to determine at any moment the positioning in height of the batten depending on the mark lying in reading position opposite device 27.

The assembly also comprises a safety brake 28.

In this way, the suspension belts 8, 8' ensure not only the support and maneovure of the batten 9 bearing the scenery and accessories associated therewith, but said belt also performs the function of electrical supply circuit for the motorization accessories associated with the batten as well as device for marking the positioning of said batten.

Operation of the assembly may be ensured by a central remote-control device.

Figure 6:
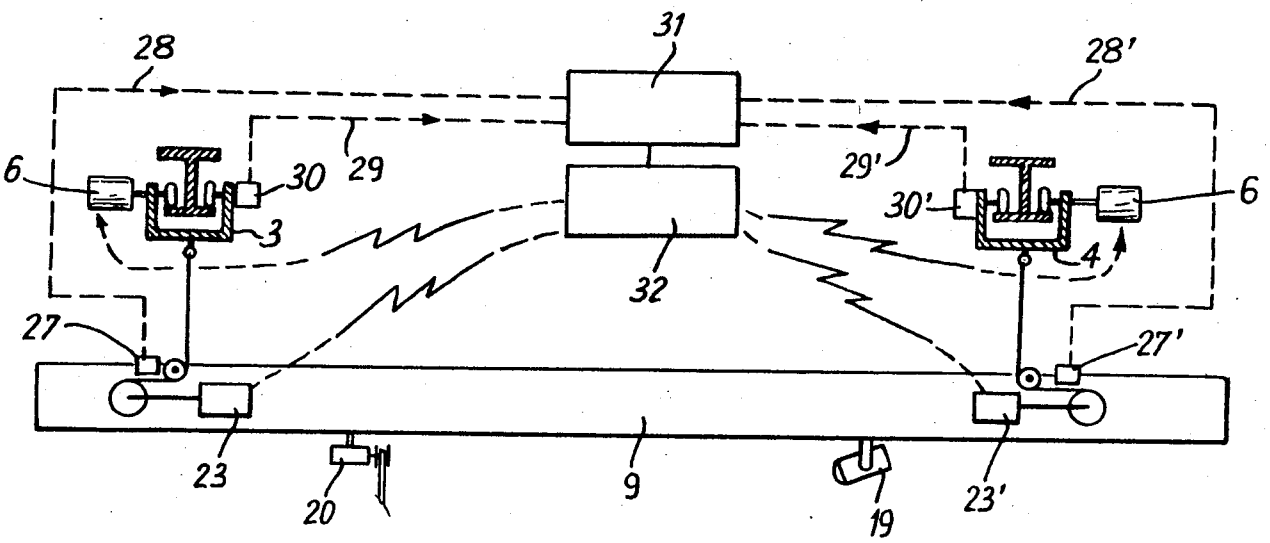
FIG. 6 shows an operational diagram of the device for remotely controlling the various motorized elements composing the scenic system of the invention.

Referring now to FIG. 6, the central remote-control device may be informed, from the reading devices 27, 27', on the positioning of the batten as a function of the coded marks disposed on the belt and lying in reading position.

This information enables the central remote-control device to know exactly the height of the batten and its position on the stage.

In fact, the central remote-control device receives the information from readers 27, 27' by circuits 28, 28'; however, this device is also informed by circuits 29, 29' as to the positioning of carriages 3 and 4 from a marking system 30, 30' which may for example be constituted by a revolution counter connected to one of the rollers of the carriage and making it possible to determine at any moment the instantaneous position of the carriage along the rail.

The receiving part 31 of the central remote-control device thus knows at any moment the exact position of the batten in the space constituted by the volume of the stage.

The information centralized at 31 may be transmitted into part 32 of the device which is adapted to emit the orders as a function of the information received and of a programme of manoeuvres pre-recorded for example on a magnetic support or from any data-processing means.

The orders may be transmitted by electro-magnetic waves to the winches 22, 22' for manoeuvring the belts 8, 8' in order to ensure displacement of the batten 9 in height.

The electro-magnetic orders from the central device 32 are received to this end by the remote-control device 33 (FIG. 2) associated with the motor 23 and ensuring starting or stopping of the latter.

The control system may ensure, in particular, thanks to the coded marks borne on the belts 8, a hoisting speed varying in time as a function of the desired programme.

At the same time, the central remote-control device 32 may address orders by electro-magnetic waves up to the motor 6 associated with each of the carriages for ensuring displacement of the batten 9 in the space constituted by the stage.

Likewise, remote-control orders by waves may be transmitted to the individual winch 20 or to the motorization device ensuring for example the displacement along the batten or the rotation of spotlight 19, or to the motorization system of the mini-carriage 25 bearing the mobile pulley 24.

FIG. 5 shows that the device of the invention may be associated with a lateral storage area.

To that end, the two rails 1 and 2 are associated, preferably towards the rear part of the stage, with two sections of rails 34, 35 which extend the two paired rails 1 and 2, with the result that the carriages 3 and 4 bearing the battens may pass from rails 1 and 2 to the sections of rails 34, 35.

The sections of rails 34, 35 are themselves suspended from a device for displacement over a transverse upper rail either of the monorail type, or formed by two rails 36, 36'; the sections of rails are to this end mounted on carriages themselves movable over rails 36, 36' so that the two sections 34, 35, bearing one or more couples of carriages and the corresponding battens, may be translated from the position on the left-hand part of the Figure in line with the stage rails 1 and 2, towards the symmetrical position corresponding to the right-hand part of the Figure and in which they come into position of alignment with respect to the storage rails 37, 38 and 39, 40, respectively.

The sections of rails 34, 35 are inserted exactly in line with the secondary storage rails 37, 38 and 39, 40, respectively.

In this way, the carriages borne by said segments of rails may then be translated either over the pair of secondary storage rails 37, 38 or over pair 39, 40.

The unused scenery may thus be easily displaced towards the lateral storage zones.

The displacement of the carriages over the linear assembly formed by the pairs of secondary rails 37, 38, the intermediate sections 34, 35 in lateral position and the secondary rails 39, 40, makes it possible to bring the desired fresh scenery onto the sections of rails 34, 35 which may then be returned into the position corresponding to the left-hand part of the Figure to be returned in line with rails 1 and 2, thus enabling fresh scenery to be brought into active position on said rails.

It may also be imagined that, beyond the movable intermediate sections of rails 34, 35, rails 1 and 2 are extended by rails 41, 42 (shown in broken lines in FIG. 5), this making it possible to adjust and modify the order of positioning of the scenery-bearing battens.

As has been set forth, the device of the invention allows considerable versatility of use and multiple scenic effects, whilst virtually eliminating manual handling by the staff thanks to a motorization and total remote-control.

Various arrangements may be provided.

For example, the scenery-bearing batten 9 may comprise on its curved faces 11 and 12 grooves 43, 44 whose edges approach each other, which make it possible to position at any appropriate spot elements and accessories capable of being displaced as desired by manoeuvring the batten.

What is claimed is:

1. A device for maneuvering scenery, particularly for stages of theatres and the like, wherein said device comprises:

at least two main rails running parallel to each other and symmetrically with respect to the front to rear axis of the stage, and being disposed above said stage;

at least one set of two carriages, each of said carriages being mounted movably along one of said rails;

at least one batten disposed in a direction substantially perpendicular to said rails; at least one scenery suspended from said batten;

two winding devices fixedly mounted to said batten, each said winding device comprising an electrical motor and a drum actuated by said motor;

at least two belts having opposite ends for maneuvering said batten, each said belt being connected at one end to the base of one carriage and at the opposite end being wound in superposed turns on said drum of said winding device such that said batten is suspended from said carriages and is vertically movable through actuation of said winding devices, said maneuvering device further comprising:

(a) a source of low voltage current;

(b) said rails being made of electrically conducting material, one of said rails being connected to one pole of said source of low voltage current, and the other of said rails being connected to the other pole;

(c) said suspension belts comprising electrically conducting material, each said belt being electrically connected at said one end to the corresponding one of said carriages which in turn is electrically connected to said rails, and at said opposite end to the electrical motor of the corresponding one of said winding devices with electrical connection between said winding devices;

(d) each said electrical motor in said winding devices comprising a remote control means for ensuring the starting and the stopping of said motor in response to a remotely transmitted signal;

(e) each said belt further comprising a plurality of coded marks along its length, said marks being suitable for reading by a reading device;

(f) at least two reading devices being disposed on said batten and positioned for reading said coded marks on each one of said belts, upstream of said winding device, said reading device being capable of checking the positioning of the batten with respect to the rails, by reading said marks;

(g) at least two guiding pulleys being disposed on said batten, each of said pulleys being adapted to receive one belt, so as to ensure the correct positioning of said belt opposite said reading devices;

(h) remote control center means for controlling the actuation of said motor in each said winding device;

(i) electrical signal transmission means, connectiong each of said reading devices to said remote control center means for transmitting to said center means information as to the instant position of said batten; and (j) said remote control center means comprising electromagnetic wave emitters for transmitting to said remote control means connected to each said motor in each of said winding devices, signals for starting and stopping each of said motors such that the movement of raising and lowering batten is controlled from said remote control center means.

2. The maneuvering device of claim 1 wherein each said carriage mounted movably along one of said main rails is provided with:

rolling means mounted to each of said carriages for providing the displacement of each said carriage along the corresponding one of said support rails, and second electrical motors to actuate each said rolling means;

a revolution counter connected to each one of said rolling means;

electrical transmission means connecting said revolution counter to said remote control center means, for indicating the instant position of the corresponding carriage along the supporting rail; and second remote control means connected to each of said second motors for ensuring starting and stopping of said second motors in response to a remotely transmitted signal, said second remote control means adapted for receiving the electromagnetic waves emitted by said remote control center means, so that said remote control center means transmits signals to said second motors to cause displacement of each said carriage along each one of said rails.

3. The maneuvering device of claim 1 further comprising: a lateral storage area and a lateral translation device;

(a) said lateral storage area comprising two secondary rails, whose profile and spaced apart relationship are identical to that of the main rails, said secondary rails being adapted to receive said carriages supporting said batten, said secondary rails being substantially parallel to said main rails;

(b) said lateral translation device comprising two movable sections of rails each supported from one of two second carriages, whose profile and spaced apart relationship are identical to said main rails; at least one transverse rail perpendicular to said main and secondary rails; said second carriages being movable over said transverse rails; and said sections of rails being suspended from said second carriages and being movable from a position in which said sections of rail are in line with said main rails to a position in which said sections of rails are in register and in line with said secondary rails of the lateral storage area, thus allowing two said carriages supporting the same said batten to be translated from said main rails to said sections of rails and laterally translated along said transverse rails to said secondary rails such that said two said carriages are transferred to said lateral storage area.

4. The maneuvering device of claim 1 wherein the cross-section of said batten is in the form of a box girder, constituted by an extruded aluminum section, having a generally ovoid form, presenting two substantially symmetrical, opposite faces which are slightly convex outwardly, the two opposite upper and lower faces of said batten comprising grooves whose edges approach each other for allowing accessories to be engaged therein.

* * * * *